US010006161B2

(12) United States Patent
Dana

(10) Patent No.: US 10,006,161 B2
(45) Date of Patent: Jun. 26, 2018

(54) SYSTEM FOR STEAM TREATMENT OF TEXTILES

(71) Applicant: Blue Spruce Holdings, LLC, Heber, UT (US)

(72) Inventor: Todd Dana, Heber, UT (US)

(73) Assignee: Blue Spruce Holdings, LLC, Salt Lake City, UT (US)

( * ) Notice: Subject to any disclaimer, the term of this patent is extended or adjusted under 35 U.S.C. 154(b) by 0 days. days.

(21) Appl. No.: 15/612,901

(22) Filed: Jun. 2, 2017

(65) Prior Publication Data

US 2017/0268156 A1 Sep. 21, 2017

Related U.S. Application Data

(63) Continuation-in-part of application No. 15/271,067, filed on Sep. 20, 2016, now abandoned, which is a (Continued)

(51) Int. Cl.
*F26B 19/00* (2006.01)
*D06F 58/20* (2006.01)
(Continued)

(52) U.S. Cl.
CPC ..... *D06F 58/203* (2013.01); *D06F 59/02* (2013.01); *D06F 73/00* (2013.01); *D06F 73/02* (2013.01); *A47G 25/20* (2013.01)

(58) Field of Classification Search
CPC ..... D06F 58/203; D06F 59/02; D06F 73/00; D06F 73/02
(Continued)

(56) References Cited

U.S. PATENT DOCUMENTS 1,191,970 A 7/1916 Hlubucek
1,489,681 A 4/1924 Wells
(Continued)

FOREIGN PATENT DOCUMENTS

EP 0122569 10/1984
JP 04327900 11/1992
(Continued)

*Primary Examiner* — John McCormack
(74) *Attorney, Agent, or Firm* — Thorpe North & Western, LLP

(57) ABSTRACT

A steam treatment system (10) for textiles can include a detachable hanger (14) which is removably attachable to a steam unit (12). The steam unit (12) can include a vaporizing element (16) which is operatively connectable to a water source (18) and is designed to produce steam. A steam outlet (20) with a shut-off valve (22) can also be part of the steam unit (12). The detachable hanger (14) can be configured to support an article of textile such as a shirt, suit, dress, slacks, towel or the like. More particularly, the hanger (14) can include a support body enclosing a steam chamber (24) and a steam inlet (26) which is removably attachable to the steam outlet (20) of the steam unit (12). In this manner the detachable hanger (14) can be removably coupled to the steam unit (12) to allow steam to fill the hanger (14). The support body can also include a plurality of steam vents or apertures (30) which are oriented to transmit steam from the steam chamber (24) to the article of textile supported thereon. Such a steam treatment system (10) can find effective application in homes and service oriented businesses such as hotels and gyms.

22 Claims, 4 Drawing Sheets

Related U.S. Application Data continuation-in-part of application No. 13/376,365, filed as application No. PCT/US2010/037291 on Jun. 3, 2010, now Pat. No. 9,447,538.

(60) Provisional application No. 61/183,688, filed on Jun. 3, 2009.

(51) Int. Cl.

| | |
|---|---|
| ***D06F 73/00*** | (2006.01) |
| ***D06F 59/02*** | (2006.01) |
| ***D06F 73/02*** | (2006.01) |
| *A47G 25/20* | (2006.01) |

(58) Field of Classification Search
USPC ..... 68/5 R, 222
See application file for complete search history.

(56) References Cited

U.S. PATENT DOCUMENTS

| | | | | | |
|---|---|---|---|---|---|
| 1,492,083 | A | | 4/1924 | Pegues | |
| 1,659,097 | A | | 2/1928 | Gygi | |
| 2,317,924 | A | | 4/1943 | Lendle | |
| 2,805,009 | A | * | 9/1957 | Jackson | D06F 73/00 223/67 |
| 2,969,897 | A | | 1/1961 | Paris | |
| 3,048,310 | A | * | 8/1962 | Dosal | D06F 73/00 223/70 |
| 3,899,108 | A | | 8/1975 | Frauendorf | |
| 4,593,839 | A | * | 6/1986 | Vandoros | A47G 25/446 223/63 |
| 4,678,424 | A | * | 7/1987 | Volk, Jr. | B30B 15/0005 425/331 |
| 4,728,015 | A | | 3/1988 | Holzapfel et al. | |
| 5,419,469 | A | | 5/1995 | Urso | |
| 5,592,750 | A | | 1/1997 | Eichten | |
| 5,676,503 | A | * | 10/1997 | Lang | B25H 1/0035 408/129 |
| 5,687,278 | A | * | 11/1997 | Turner | D06F 73/00 219/211 |
| 7,059,518 | B2 | | 6/2006 | Forster | |
| 7,133,740 | B1 | | 11/2006 | Stenson et al. | |
| 7,273,173 | B2 | | 9/2007 | Forster | |
| D561,958 | S | | 2/2008 | Hahn | |
| 2004/0068888 | A1 | * | 4/2004 | Lurie | A47L 23/20 34/90 |
| 2006/0000164 | A1 | * | 1/2006 | Raeburn | B32B 27/12 52/219 |
| 2008/0136598 | A1 | | 6/2008 | Chen et al. | |
| 2008/0155757 | A1 | * | 7/2008 | Kim | D06F 58/10 8/149.3 |
| 2008/0256989 | A1 | * | 10/2008 | Jeong | D06F 58/14 68/5 C |
| 2009/0249639 | A1 | * | 10/2009 | Kim | D06F 25/00 34/389 |

FOREIGN PATENT DOCUMENTS

| | | |
|---|---|---|
| JP | 2001232099 | 8/2001 |
| WO | WO2007/108606 | 9/2007 |

* cited by examiner

SYSTEM FOR STEAM TREATMENT OF TEXTILES

RELATED APPLICATIONS

This application is a continuation-in-part of U.S. patent application Ser. No. 15/271,067, filed on Sep. 20, 2016, which is also a continuation-in-part of U.S. patent application Ser. No. 13/376,365, filed Mar. 20, 2012, which is a U.S. nationalization under 35 U.S.C. 371 of PCT Application No. PCT/US2010/037291, filed Jun. 3, 2010, which claims the benefit of U.S. Provisional Patent Application No. 61/183,688, filed Jun. 3, 2009, which are each incorporated herein by reference in their entireties.

BACKGROUND OF THE INVENTION

Care and maintenance of clothing and other textiles has long been a routine and often tedious chore. Washing and drying of clothing frequently leaves clothing with wrinkles or in an otherwise undesirable condition. It is well recognized that ironing is time consuming. As a result, clothes are often used without ironing. Further, it is common for business travelers to routinely place wrinkled clothing in a closed bathroom with hot water running in the bath or shower to remove or reduce wrinkles.

Unfortunately, such an approach leads to excessive waste of water and energy used to heat the water. In addition, the effectiveness of this approach in removing wrinkles can be limited by time constraints and can depend on the particular clothing material.

SUMMARY OF THE INVENTION

In light of the problems and deficiencies note above, the present inventor has recognized that an integrated steam treatment system can provide effective steaming and/or other treatments of textiles in a controlled manner. This steam treatment system can substantially reduce wasted resources and produce an article of clothing or textile having an improved appearance.

As such, a steam treatment system for textiles can include a detachable hanger which is removably attachable to a steam unit. The steam unit can include a vaporizing element which is operatively connectable to a water source and is designed to produce steam. A steam outlet with a shut-off valve can also be part of the steam unit. The detachable hanger can be configured to support an article of textile such as a shirt, suit, dress, slacks, towel or the like. More particularly, the hanger can include a support body enclosing a steam chamber and a steam inlet which is removably attachable to the steam outlet of the steam unit. In this manner the detachable hanger can be removably coupled to the steam unit to allow steam to fill the hanger. The support body can also include a plurality of steam vents or apertures which are oriented to transmit steam from the steam chamber to the article of textile supported thereon.

There has thus been outlined, rather broadly, the more important features of the invention so that the detailed description thereof that follows may be better understood, and so that the present contribution to the art may be better appreciated. Other features of the present invention will become clearer from the following detailed description of the invention, taken with the accompanying drawings and claims, or may be learned by the practice of the invention.

BRIEF DESCRIPTION OF THE DRAWINGS

The present invention will become more fully apparent from the following description and appended claims, taken in conjunction with the accompanying drawings. It is to be understood that these drawings merely depict exemplary embodiments of the present invention and they are, therefore, not to be considered limiting of its scope. It will be readily appreciated that the components of the present invention, as generally described and illustrated in the figures herein, could be arranged, sized, and designed in a wide variety of different configurations. Nonetheless, the invention will be described and explained with additional specificity and detail through the use of the accompanying drawings in which:

DETAILED DESCRIPTION OF EXEMPLARY EMBODIMENTS

Figure 1A:
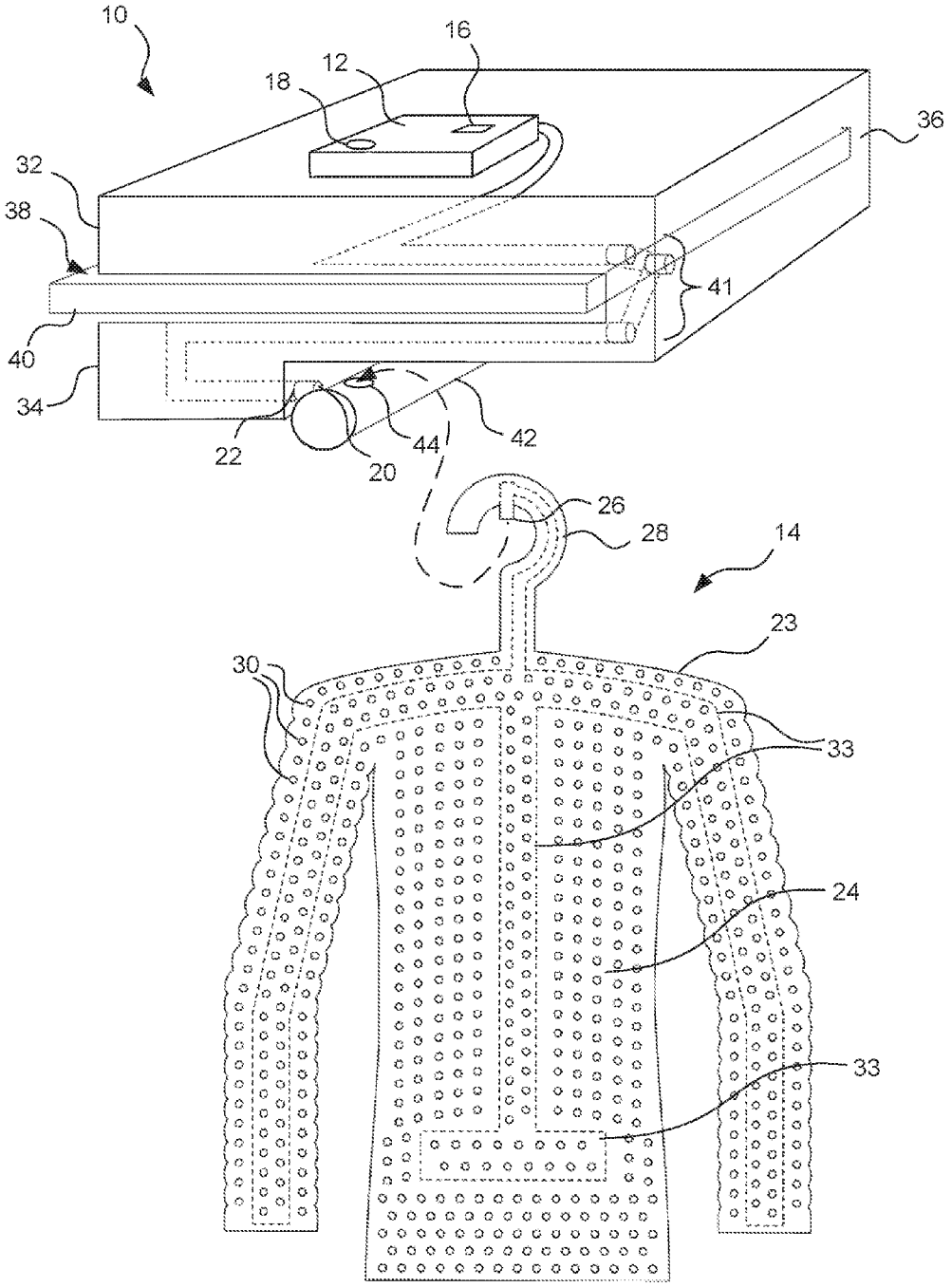
FIG. 1A is a perspective view of a steam treatment system slid onto a shelf in accordance with one embodiment of the present invention.

The following detailed description of exemplary embodiments of the invention makes reference to the accompanying drawings, which form a part hereof and in which are shown, by way of illustration, exemplary embodiments in which the invention may be practiced. While these exemplary embodiments are described in sufficient detail to enable those skilled in the art to practice the invention, it should be understood that other embodiments may be realized and that various changes to the invention may be made without departing from the spirit and scope of the present invention. Thus, the following more detailed description of the embodiments of the present invention is not intended to limit the scope of the invention, as claimed, but is presented for purposes of illustration only and not limitation to describe the features and characteristics of the present invention, to set forth the best mode of operation of the invention, and to sufficiently enable one skilled in the art to practice the invention. Accordingly, the scope of the present invention is to be defined solely by the appended claims.

The following detailed description and exemplary embodiments of the invention will be best understood by reference to the accompanying drawings, wherein the elements and features of the invention are designated by numerals throughout.

Definitions

In describing and claiming the present invention, the following terminology will be used.

The singular forms "a," "an," and "the" include plural referents unless the context clearly dictates otherwise. Thus, for example, reference to "a steam outlet" includes reference to one or more of such features and reference to "attaching" refers to one or more such steps.

As used herein with respect to an identified property or circumstance, "substantially" refers to a degree of deviation that is sufficiently small so as to not measurably detract from the identified property or circumstance. The exact degree of deviation allowable may in some cases depend on the specific context.

As used herein, "adjacent" refers to the proximity of two structures or elements. Particularly, elements that are identified as being "adjacent" may be either abutting or connected. Such elements may also be near or close to each other without necessarily contacting each other. The exact degree of proximity may in some cases depend on the specific context.

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary.

Concentrations, amounts, and other numerical data may be presented herein in a range format. It is to be understood that such range format is used merely for convenience and brevity and should be interpreted flexibly to include not only the numerical values explicitly recited as the limits of the range, but also to include all the individual numerical values or sub-ranges encompassed within that range as if each numerical value and sub-range is explicitly recited. For example, a numerical range of about 1 to about 4.5 should be interpreted to include not only the explicitly recited limits of 1 to about 4.5, but also to include individual numerals such as 2, 3, 4, and sub-ranges such as 1 to 3, 2 to 4, etc. The same principle applies to ranges reciting only one numerical value, such as "less than about 4.5," which should be interpreted to include all of the above-recited values and ranges. Further, such an interpretation should apply regardless of the breadth of the range or the characteristic being described.

Any steps recited in any method or process claims may be executed in any order and are not limited to the order presented in the claims. Means-plus-function or step-plus-function limitations will only be employed where for a specific claim limitation all of the following conditions are present in that limitation: a) "means for" or "step for" is expressly recited; and b) a corresponding function is expressly recited. The structure, material or acts that support the means-plus function are expressly recited in the description herein. Accordingly, the scope of the invention should be determined solely by the appended claims and their legal equivalents, rather than by the descriptions and examples given herein.

Steam Treatment Systems

A steam treatment system 10 for textiles can include a steam unit 12 and a detachable hanger 14 as shown in FIG. 1A. Each element of the system will be described in more detail below. However, generally the steam unit can include a vaporizing element 16 operatively connectable to a water source 18 to produce steam. A steam outlet 20 can be adjacent to or remote from the vaporizing element. The steam outlet can also include a shut-off valve 22 to prevent steam escape when the detachable hanger 14 is not engaged with the steam outlet.

The detachable hanger 14 can be configured to support an article of textile. Thus, various shapes can be used to support different types of clothing or other textiles, e.g. shirts, slacks, dresses, suits, towels, and the like. Generally, the detachable hanger can include a support body 23 enclosing a steam chamber 24. A steam inlet 26 can be oriented on the hanger at a point of attachment to the hanger connection 44 of the steam unit. In one aspect, the steam inlet can be oriented on a hook member 28 and oriented downward to engage with the steam outlet. The hook member can extend from the support body in a standard conventional wire hanger hook fashion. The steam inlet can also be oriented within an upper-most point of an inner surface of the hooked support such that the steam inlet is oriented facing downward. In this configuration, the weight of the hanger (and textile) can aid in securing a connection between the steam outlet and the steam inlet. The steam inlet can alternatively be oriented in other directions as long as a secure connection is provided. For example, the steam inlet can be configured such that the hanger is engaged with the steam outlet via a substantially vertical motion downward. The hanger connection and steam inlet of the hanger can alternatively be provided as a horizontal slide connection (i.e. an L-shape support which engages with a complimentary port on the hanger connection). Optional guide contours or walls can be integrated into the connection system to allow for mechanical positioning and for sealing the steam connection. For example, a male and female guide contours can ensure that a steam seal is formed and avoid misplaced hangers, or searching for the connection.

Regardless of the specific orientation, the steam inlet can be configured to be removably attachable to the steam outlet. Although not required, it can be desirable to configure the engagement design such that the act of engaging the hanger substantially completes the fluid connections which are triggered by the weight of the hanger. A number of connector designs can be suitable. In one aspect, the connector can be a quick-connect. Non-limiting examples of suitable connectors can include a poppet style quick-connect, a drybreak quick-connect, a gravity weighted solenoid and the like. In another aspect, one or both of the steam inlet and steam outlet can include a magnetic member to assist in guiding and securing the connection. In one detailed aspect, the connector can be a magnetic seal such that no other sleeves or mechanism is required. In this case, the magnetic seal acts as a magnetic guide with sufficient weight and magnetic strength to maintain a steam seal. Such embodiments can optionally include an enclosure to spatially guide the magnetic seal counterparts and may include a rubber seal to reduce or eliminate steam leakage.

Although the detachable hanger can have fixed dimensions, providing adjustable dimensions for shoulders, width and/or length can increase the versatility of the hanger for different garments. Consistent with this concept, in one aspect, the support body can optionally include a pair of shoulder supports configured to support shoulders of the shouldered garment. More particularly, the pair of shoulder supports can be positionable for adjustable shoulder width. Adjustability can be accomplished by any suitable mechanism. For example, the shoulder portions can be telescoping, folding or can include detachable segments. Similarly, the steam chamber can optionally further includes a length adjustment mechanism configured to extend a length of the support body and steam chamber. In this way, the mechanism can allow a user to length-wise adjust positioning of at least a portion of the steam vents. This can be important for garments such as a dress where it may be desirable to direct or distribute steam over a significantly longer distance than, for example a dress shirt.

In order to offer direct steaming or treatment to all segment of the clothing, additional members can be provided to direct steam to targeted areas of the clothing. For example, in one optional aspect, the support body can include a pair of tubular arm members which are flexible and include steam apertures therein. As a result, when the tubular arm members are inserted into arms of an article of clothing, the steam can be directed into the arms to provide a thorough steam treatment throughout the sleeve lengths.

Further, the support body can include a plurality of steam vents 30 oriented to transmit steam from the steam chamber 24 to the article of textile. The steam vents can typically be apertures distributed throughout the support body and/or in selected regions. In one aspect, the support body can be substantially hollow and include a single cavity to form the steam chamber. However, a plurality of steam channels 33 can be optionally included to direct steam to different zones of the steam chamber. For example, a steam manifold or divider can be integrated adjacent to or near the steam inlet to produce multiple steam lines. Each steam line can selectively direct a portion of the steam to different areas of the support body, e.g. lower regions, side regions, arms, center, etc.

Within the support body and steam chamber, steam or other fluids may condense and accumulate within the chamber. Thus, an excess fluid outlet can be integrated into the steam chamber to allow removal of the excess fluid from the chamber. This can help to prevent clogging and/or pressure buildup. In one aspect, the support body can includes a vacuum line having a suction end oriented in a lower region of the steam chamber to collect and remove condensed water and/or excess steam vapor from the steam chamber. The vacuum line can be oriented through a common connector as the steam inlet or through a separately attached line (not shown). Alternatively, a gravity drain outlet can be oriented in the bottom of the steam chamber to allow excess liquid to be removed.

The steam unit can have an enclosure which is configured for a particular functional and/or aesthetic application. Various configurations can allow the system to be attached to a shelf, door, divider wall, embedded in a wall, or suspended between two walls, to name a few options. In one alternative, the steam unit can be shaped to slide over a planar fixture such as a shelf, a door, and a divider wall. When designed for shelf-mounting, the shelf can be a fixed wall-mounted shelf, a cabinet shelf, a wardrobe shelf, or the like. This general shape for mounting on shelves or other planar fixtures can be a U-shape such as that shown in FIG. 1A. In this configuration, the steam unit includes an upper member 32 coupled to a lower member 34 via a front bridge member 36 such that a gap 38 is formed between the upper member and the lower member such that the steam unit is configured to slide onto the planar fixture 40. In this manner, the steam unit can be readily installed onto existing shelves with minimal, if any, modifications to the existing shelves. Although FIG. 1A illustrates a horizontal fixture, vertical or inclined fixtures can also be used. For example, a divider wall can provide support. The steam unit and hanger attachment points can be adjusted accordingly to allow the hangers to hang with sufficient clearance from the wall or other structures.

Although many shelves have a similar width, there are variations in widths such that achieving a secure interface with the shelf is desirable. As such, a securing mechanism can be used to affix the steam unit to the planar fixture. In one aspect, the securing mechanism can be a gap adjustment mechanism. In this case, the front bridge member can include the gap adjustment mechanism configured to allow variable adjustment of a width of the gap. Thus the front bridge member can be adjustable to allow for varying gap distances. The front bridge member can include sliding walls, accordion walls, or the like. In some designs, the steam, electrical connections, secondary fluids, or other system lines can pass through the front bridge member. Therefore, accommodation for movement can be made to allow such connections to expand or move with the gap adjustment. Although other designs can be suitable, examples of the gap adjustment mechanism for such connections can include a toggle joint, a flexible hose joint, or a telescoping joint. Multiple independent steam lines, electrical lines, and/or fluid lines can be passed through such gap adjustment mechanisms or in the front bridge member. FIG. 1A illustrates an example of a toggle joint 41 where three rotating joints are oriented to allow vertical movement relative to the upper and lower joints such that the upper member 32 can be displaced from the lower member 34 to adjust the gap width while maintaining the steam line connection. Each of the upper and lower members can optionally include friction surfaces and/or securing mechanism which secure the steam unit to the planar fixture. Friction surfaces can include, but are not limited to, rubber, PDMS, adhesive, and the like, while the securing mechanisms can include tabs or holes into which screws can be driven into the planar fixture.

In one set of embodiments, the steam unit can include a hanger support member which is configured to mechanically support the detachable hanger(s). In one aspect, the steam unit can further include a steam chambered rod 42 including the steam outlet 44. In this embodiment, the chambered rod is fluidly connected to the water source to allow the steam to flow into the chambered rod. The rod can optionally be sized to accommodate standard clothing hangers, e.g. a diameter from about ¾ inch to about 2 inches. The rod can optionally include spacing grooves or other contours. In such a case, there can be one or more steam outlets 44 oriented along the rod length and either grouped in one region of the rod or spaced such that detachable hangers and conventional hangers can be intermingled.

In one alternative, the steam unit is shaped to slide into a cut-out area of a shelf. In this case, a main body of the steam unit can include multiple flanges or a continuous recessed outer flange area such that the main body fits into the cut-out area and the flanges rest on the shelf along edges of the cut-out area.

In another alternative embodiment, the steam treatment system can be configured as a rod. For example, the rod can be configured to mount in opposing side walls of a closet at opposing ends of the rod. The rod can include a water or steam inlet and the steam outlets as described previously. As such, the vaporizing element can be integrated into the rod. In this case, the rod can include a water inlet and the steam is produced internally within the rod. Optionally, the steam can be produced separately such as by a steam boiler which is oriented nearby having a steam line which is fluidly connected to the rod. Such a boiler can be placed on the shelf above the rod, on the floor, or in a separate centralized location. In one aspect, a common steam boiler can be connected to multiple rod-hanger systems throughout a home or building, e.g. a hotel. Such a configuration may be particularly useful for a hotel where dozens of such steam treatment systems in various rooms can be fluidly connected to a common steam boiler. Alternatively, the steam boiler can be removably detachable from the steam outlet such that the steam unit is configured for use as a hand-held steam cleaner. Such a design can add functionality to the system by allowing the steam boiler to be used to steam clean draperies, upholstery, carpets, and the like. Optional attachments can be used as are commonly known used for hand-held steam cleaners.

In one aspect, the rod can include a steam-sealed length adjustment mechanism configured to allow adjustment of the rod length. Thus, the rod length can be customized to fit a variety of closet sizes or other placements. The length adjustment mechanism can be any which allow for changing the rod length while also maintaining a steam seal. In one aspect, this can include providing isolated flexible channels within the rod body which extend with the rod. The flexible channels can be directly and individually connected to the steam outlet or outlets. Alternatively, the steam-sealed length adjustment can be a threaded joint between at least two rod segments, a compression washer oriented between two rod segments, a detent, threaded clutch, split collar lock, snap collar lock, internal cam lock, or set screw. In another aspect, the rod can be resiliently flexible to allow extension and contraction of the length. In yet another aspect, the adjustable rod can have a non-adjustable portion that produces steam and at least one other portion that does not produce steam.

Figure 1B:
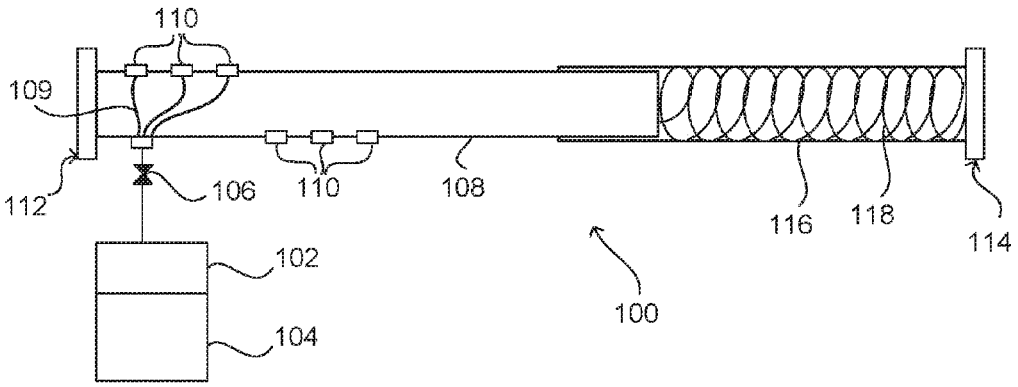
FIG. 1B is a side cross-sectional view of a length-adjustable steam rod in accordance with another embodiment of the present invention.

For example, as illustrated in FIG. 1B, a steam unit 100 can include a vaporizing element 102 operatively connectable to a water source 104 to produce steam. The system can also include a steam outlet fluidly connected to receive steam produced by the vaporizing element 102 and direct the steam into a steam distribution chamber 108. The steam outlet may include a shut-off valve 106 to control flow of steam into the steam distribution chamber through a corresponding water inlet. The steam distribution chamber 108 can have multiple steam outlets 110. The steam outlets 110 are each removably connectable to corresponding hangers as described further herein.

In this example, the steam unit 100 is a rod configured to mount in opposing side walls of a closet at opposing ends (112 and 114) of the rod. The length adjustment mechanism can generally be such that the rod is adjustable in length without loss of steam seal. As illustrated, the rod can include two portions which telescope with respect to one another. The telescoping portions can be fixed in position to adjust the length of the rod to fit varying size closets and locations. In one example, the length adjustment mechanism can be a threaded joint between the at least two rod segments. Alternatively, the length adjustment mechanism can be a compression washer oriented between the at least two rod segments. The compression washer is then engaged upon rotating each of the segments with respect to one another to fix the rod length and optionally engage a steam seal. FIG. 1B illustrates an example having a segment 116 with an engagement spring 118 biasing the two segments apart.

In one alternative, the vaporizing element 102 can be oriented within the rod (e.g. within the steam distribution chamber 108). In this way, the steam distribution chamber can be directly filled with water manually via a corresponding fill opening, or via a water source line. This can reduce an overall system footprint. In another alternative, the steam unit 100 can include flexible steam channels 109 within the steam distribution chamber 108 to direct the steam to each of the steam outlets 110.

In still another example, the system can also include at least one detachable hanger configured to support an article of textile. The hanger can include a support body enclosing a steam chamber and a steam inlet removably attachable to the steam outlet. The support body can include a plurality of steam vents oriented to transmit steam from the steam chamber to the article of textile as described previously herein.

In yet another aspect, the steam unit can be configured to collapse in a non-working state to slide underneath a bed, e.g. typically having a clearance of less than 10 inches. In such embodiments the enclosure and any extending members can be configured to have a low profile for convenient storage.

Figure 2:
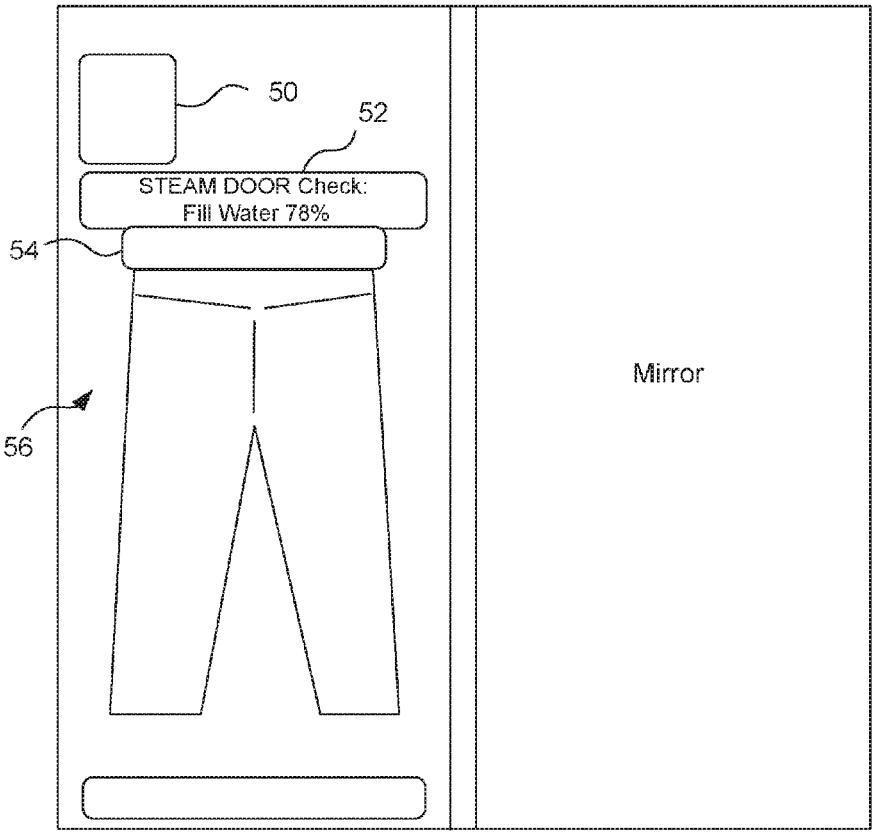
FIG. 2 is a front plan view of a steam treatment system in a door or wall installation in accordance with one embodiment of the present invention.
Figure 3:
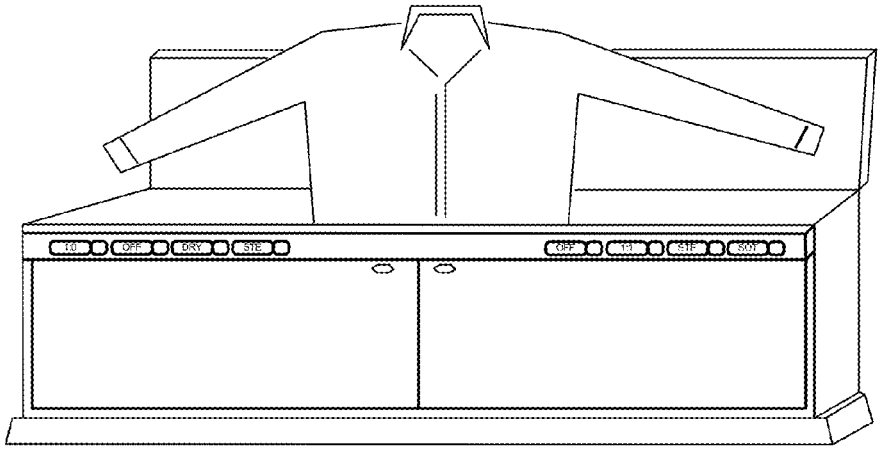
FIG. 3 is a front perspective view of a steam treatment system configured as a dresser in accordance with one embodiment of the present invention.
Figure 4:
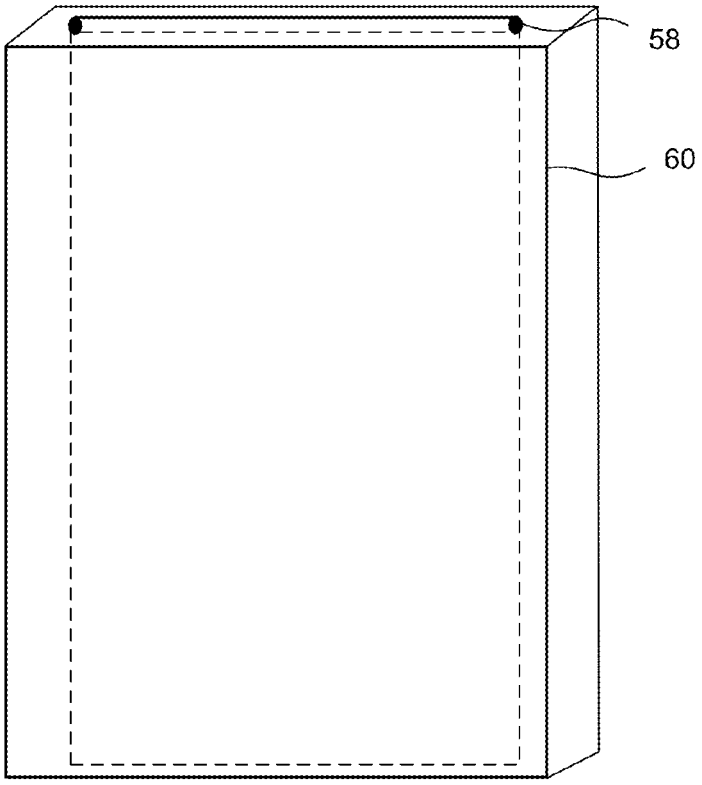
FIG. 4 is a front perspective view of a steam treatment system for a towel in accordance with one embodiment of the present invention.

The steam treatment system including a water source 50, steam unit 52, and detachable hanger 54 can optionally be mounted on an inner panel of a door 56 or wall as shown in FIG. 2. This can be accomplished by drilling, adhesive or other means directly on the door surface. Alternatively, the steam unit can be configured to be embedded in a door or wall. Such an installation can reduce space occupied by the system and also allow for a custom appearance. Water inlets can be optionally integrated into the door via suitable flexible connectors. In yet another alternative, the steam unit can be configured as a stand-alone steam dresser as shown in FIG. 3. Although clothing can be readily steam treated using the systems of the present invention other textiles such as towels, sheets, tablecloths, and the like can also be treated. FIG. 4 illustrates a towel system where the detachable hanger is a rod 58 over which the towel 60 can be draped. Alternatively, the detachable hanger can be configured as a panel such that the entire length of the towel is exposed to steam treatment. Such detachable hangers can also be suitable for clothing such as slacks, vests, robes, and the like.

In each of the described embodiments of the steam treatment system, the following additional aspects can also be used. The water source can be integrated into the system such that the system can act as a stand-alone device. More particularly, the water source can be a refillable tank having a fill inlet. In this case, the water source can be manually refilled as needed. Alternatively, the water source can be a fixed water supply line, e.g. a public water supply, to which the system can be connected. As previously discussed, the steam generator or vaporizing element can be placed in the tank or can be fluidly connected to the tank via an outlet water line. For example, the water source can be a water supply line and the vaporizing element can be connected to the water supply line via a water-line connector. Alternatively, the vaporizing element is housed in an external boiler configured to produce the steam. This steam unit can further include a steam line fluidly connected to the external boiler to the steam outlet.

Figure 5:
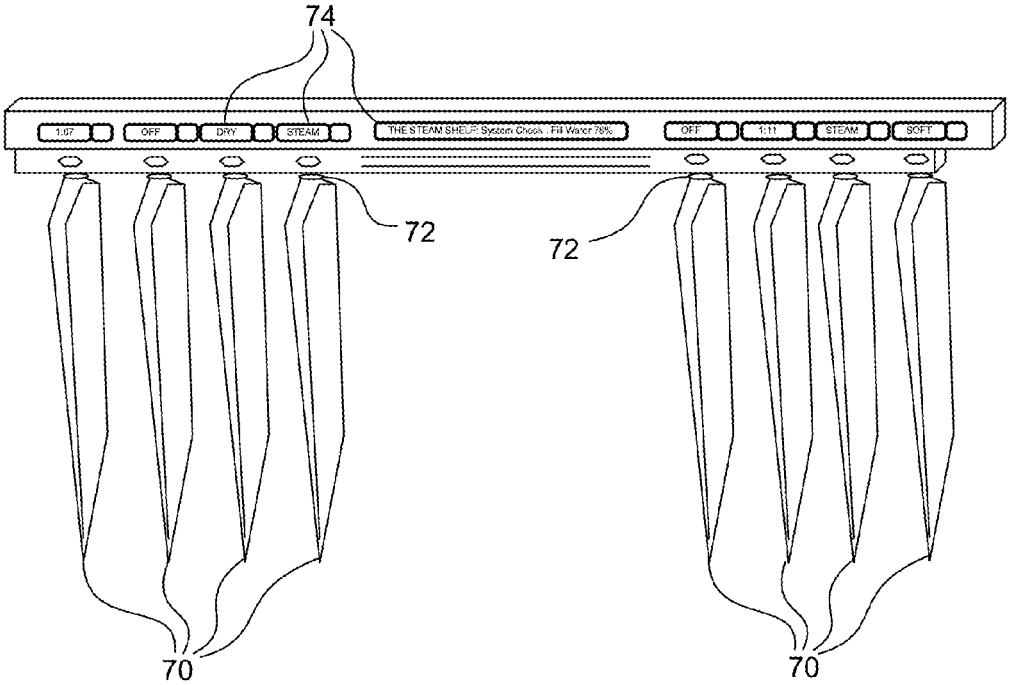
FIG. 5 is a front perspective view of a steam treatment system showing multiple detachable hangers in accordance with one embodiment of the present invention.

Optionally, additional optional convenience features can be incorporated into the design. In one basic aspect, the system can include a single detachable hanger. However, multiple detachable hangers 70 and complimentary steam outlets 72 can be provided as shown in FIG. 5. The steam outlets can be operated along a common fluid/steam delivery such that the same fluid treatment occurs for each article of textile. However, in many cases customized treatment cycles can be desired. In such cases, each hanger-steam outlet combination can have an independently controllable treatment cycle. Such cycles can be as simple as a manual on-off switch or can include customizable multi-fluid cycles as described in more detail below. Regardless, the steam unit can include multiple steam outlets which each include a corresponding shut-off valve. The multiple outlets can each have a dedicated steam line from the vaporizing element or steam source.

In one aspect, the system can include a cycle control unit configured to selectively control flow of steam through the steam outlet. This cycle control unit can be applied to single or multiple hanger designs. The cycle control unit can be configured to control a variety of variables such as steam delivery times, number of repeat cycles, additional secondary fluid treatments, and the like. FIG. 5 illustrates optional indicators 74 which show the current status of each hanger cycle, water fill levels, and/or other system status information. This system can also control steam flow for safety purposes. For example, the system can be operatively connected to the shut-off valves at each steam connection. A locking mechanism can also be integrated into the connector in order to prevent removal of the hanger when the connection is steam pressurized. This can be beneficial to prevent accidental removal of the hanger during a steam or cleaning cycle. The locking mechanism can be a lock pin, detent, or other suitable lock system that prevents removal of the hanger from the steam outlet when steam is present. The lock system can alternatively include a manual override. In another option, the lock system can include a one-way valve within the steam hanger which allows steam to enter but not to escape from the same route. The steam unit can then be equipped with either a mechanical lock system and/or a software protocol which shuts down steam flow when internal pressure drops below a threshold value (i.e. indicating a leak in the system).

In one specific aspect, the system can include at least one secondary fluid line fluidly coupled to the steam outlet configured to deliver a secondary fluid to the shut-off valve. The secondary fluid line can also be connected to a secondary fluid reservoir. The secondary fluid can be at least one of a fragrance, a cleaning agent, a fabric softener, dry air, and a spot remover. In order to selectively control when the secondary fluid(s) is delivered, the secondary fluid line can be coupled to the steam outlet via a secondary fluid valve which is responsive to the cycle control unit. Similarly, a supplemental fluid can be mixed with the water source or introduced into the steam. Non-limiting examples of supplemental fluids can include carbon dioxide, fragrance, and fabric softener.

The system can further include a garment detection mechanism configured to correlate the article of textile with the treatment cycle. In this manner, a customized treatment cycle can be applied to a particular garment based on a predetermined cycle. Such customized cycles can be affected by the type of material (e.g. wool, silk, cotton, etc.), weight or thickness of the material, size of the garment, weave density, and the like. Such customized cycles can be stored in the cycle control unit or programmed by the user.

In one aspect, the garment detection mechanism can includes an RFID tag located on either the article of textile or the detachable hanger. An RFID receiver can be electrically coupled to the cycle control unit which is configured to recognize the RFID tag upon engagement of the detachable hanger with the steam unit. Thus, the steam unit can also act as a base module and a steam control center.

The cycle control unit can be pre-programmed, user programmed and/or updatable via a suitable input source. Accordingly, the cycle control unit can be electrically coupled to a data communication link unit configured to receive customized cycle data for corresponding garments. Although other data communication link units can be used, non-limiting examples include at least one of a USB port, a wireless card, an Ethernet adapter, a memory card slot, and a set of manual user controls. In one specific aspect, the data communication link unit can include an Internet connectivity unit configured to receive cycle instructions remotely from a user which include at least start of a steam cycle for a designated hanger unit.

Each portion of the steam treatment system can be formed of suitable materials based on corrosion resistance, mechanical strength and performance. For example, polymers used which are in contact with the steam will generally have an operating temperature tolerance of at least 120° F., and in some cases up to about 320° F.

An additional aspect of the steam treatment system can include safety features which prevent unintentional contact with steam, leakage, and/or system damage. In one aspect, the shut-off valve can be manually actuated. However, a safety shut-off unit can be configured to terminate delivery of steam to the detachable hanger upon a trigger event. The safety shut-off unit can be coupled to the shut-off valve and configured to close the shut-off valve. This can be any suitable device such as but not limited to a solenoid. In another aspect, the safety shut-off unit can be coupled to the steam unit and configured to terminate power to the vaporizing element. The trigger event can be at least one of mechanical pressure on the detachable hanger, opening of a closet door, and exceeding a critical temperature within the steam chamber. For example, a child pulling on the detachable hanger can indicate an undesirable risk. Similarly, a vaporizing element shut-off can be coupled to the vaporizing element and can be configured to stop steam production upon a trigger event. Such trigger events can include at least one of exceeding a critical steam pressure, exceeding a critical steam temperature, and failure of the shut-off valve. In either case, if the steam exceeds a certain temperature or pressure this can indicate a blockage or other malfunction.

The detachable hangers can be open and unenclosed. However, it can often be desirable to at least partially enclose the detachable hanger and article of clothing in order to increase steam residence time and localize the steam around the article of clothing. This can be accomplished by installing the system within an enclosed structure such as a closet or wardrobe. The closet doors can be fitted with a switch which is connected to the cycle control unit and which can be used to pause the cycle treatment. In still another aspect, a shroud can be configured to individually enclose the article of textile to increase steam residence time. Such a shroud can be sized to fit around the article of clothing. In one optional aspect, the shroud can be configured to reversibly retract above the detachable hanger.

Excess vapor and steam can be removed from the system or vicinity of the article of textile using a vent system. In one option the vent system can be oriented within the steam source and includes a vent outlet. The vent outlet duct can optionally include a filter or condenser. The vent outlet can optionally be powered, e.g. using a fan, to force steam/vapor from the system. The powered vent can be configured to exhaust to an adjacent area. The exhaust can be directed to outside environment or can be directed to another area such as a room or attic space. In one aspect, the exhaust can be directed to a room for use as a humidifying unit. In order to add convenience in installation, the vent system can include an adjustable vent configured with a telescoping length.

Depending on the water source, additional water softening may be desirable. Therefore, in one aspect, the steam treatment system can further include a water softener unit. The water softener unit can be oriented upstream of the water inlet or integrated with the steam unit.

In one aspect, at least one undermount light can be mounted on the system and directed toward the detachable hanger so as to illuminate the article of clothing.

In another optional aspect, the steam treatment system can include adjustable panels configured to extend various walls of the system to fill a particular installation area. For example, in one aspect, width adjustment panels can be configured to extend from ends of the steam unit to extend the width of the steam unit to substantially correspond to a width of the planar fixture. In the case of a shelf, the expanded system has the appearance of filling the entire shelf width. Additionally, such panels can provide supplemental storage space, storage compartments, and/or raised edges which keep objects contained therein.

Specific aspects described herein with reference to a particular embodiment can, in most cases, be applied to other described embodiments. For example, the undermount lights described for the planar fixture can also be applied to the stand-alone rod, dresser style, or other embodiments. Similar interchangeability for other detailed aspects can be made among various embodiments.

The foregoing detailed description describes the invention with reference to specific exemplary embodiments. However, it will be appreciated that various modifications and changes can be made without departing from the scope of the present invention as set forth in the appended claims. The detailed description and accompanying drawings are to be regarded as merely illustrative, rather than as restrictive, and all such modifications or changes, if any, are intended to fall within the scope of the present invention as described and set forth herein.

What is claimed is:

1. A steam treatment system for textiles, comprising:

a steam unit including a vaporizing element operatively connectable to a water source to produce steam, a steam outlet, said steam outlet including a shut-off valve, wherein the steam unit is a rod configured to mount in opposing side walls of a closet at opposing ends of the rod and including a water inlet, and a length adjustment mechanism such that the rod is adjustable in length without loss of steam seal, wherein the steam contained in the rod is contained in a non-adjustable length portion, and an adjustable length portion is not configured to contain steam.

2. The system of claim 1, wherein the vaporizing element is oriented within the rod.

3. The system of claim 1, wherein the steam unit further comprises flexible steam channels within the rod to direct the steam to the steam outlet.

4. The system of claim 1, wherein the length adjustment mechanism is a threaded joint between at least two rod segments.

5. The system of claim 1, wherein the length adjustment mechanism is a compression washer oriented between at least two rod segments.

6. The system of claim 1, wherein the length adjustment mechanism comprises a detent, threaded clutch, split collar lock, snap collar lock, internal cam lock, or set screw.

7. The system of claim 1, wherein the rod is resiliently flexible to allow extension and contraction of the length.

8. The system of claim 1, further comprising a detachable hanger configured to support an article of textile, said hanger including a support body enclosing a steam chamber and a steam inlet removably attachable to the steam outlet, the support body including a plurality of steam vents oriented to transmit steam from the steam chamber to the article of textile.

9. The system of claim 8, wherein the support body includes the steam inlet oriented in a hooked support extending from an upper portion of the support body.

10. The system of claim 9, wherein the steam inlet is oriented within an upper-most point of an inner surface of the hooked support and wherein the steam inlet is oriented facing downward.

11. The system of claim 10, wherein the steam inlet and the steam outlet are removably attachable via a quick connect mechanism.

12. The system of claim 4, wherein the quick connect mechanism is at least one of poppet style, drybreak, gravity-weighted, and magnetic seal.

13. The system of claim 8, wherein the steam chamber further includes a length adjustment mechanism configured to extend a length of the support body and steam chamber to length-wise adjust positioning of at least a portion of the steam vents.

14. The system of claim 8, wherein the support body further includes a plurality of steam channels configured to direct steam to different zones of the steam chamber.

15. The system of claim 1, wherein the steam unit is shaped to slide over a planar fixture.

16. The system of claim 9, wherein the steam unit further includes a steam chambered rod including the steam outlet, wherein the steam unit further comprises a chambered rod fluidly connected to the water source to allow the steam to flow into the chambered rod.

17. The system of claim 15, wherein the steam unit includes an upper member coupled to a lower member via a front bridge member such that a gap is formed between the upper member and the lower member such that the steam unit is configured to slide onto the planar fixture.

18. The system of claim 17, wherein the front bridge member includes a gap adjustment mechanism configured to allow variable adjustment of a width of the gap.

19. The system of claim 1, wherein the steam unit includes a water reservoir wherein the vaporizing element is oriented within the water reservoir.

20. The system of claim 1, wherein the vaporizing element is fluidly connected downstream of a water reservoir.

21. The system of claim 1, wherein the steam unit further includes multiple steam outlets each including a corresponding shut-off valve.

22. The system of claim 21, wherein the multiple steam outlets each have a dedicated steam line.

* * * * *